United States Patent [19]

Kasahara et al.

[11] 4,422,405

[45] Dec. 27, 1983

[54] COLOR ELECTROSTATOGRAPHIC APPARATUS

[75] Inventors: Nobuo Kasahara; Tosio Nakahara; Hidetoshi Yano, all of Tokyo, Japan

[73] Assignee: Ricoh Company, Ltd., Tokyo, Japan

[21] Appl. No.: 958,872

[22] Filed: Nov. 8, 1978

[30] Foreign Application Priority Data

Nov. 25, 1977 [JP] Japan ..... 52-141173

[51] Int. Cl.[3] ..... G03G 15/09; G03G 15/00

[52] U.S. Cl. ..... 118/658; 355/3 DD

[58] Field of Search ..... 118/658, 645; 355/3 R, 355/3 DD, 4; 427/18

[56] References Cited

U.S. PATENT DOCUMENTS

| | | | |
|---|---|---|---|
| 3,900,003 | 8/1975 | Sato et al. | 118/645 |
| 3,960,444 | 6/1976 | Gundlach et al. | 118/658 |
| 3,970,042 | 7/1976 | Rees | 355/4 |
| 3,998,184 | 12/1976 | Hudson | 118/658 |
| 4,030,445 | 6/1977 | Takenaga | 118/645 |
| 4,077,358 | 3/1978 | Kito | 118/645 |

*Primary Examiner*—John E. Kittle
*Assistant Examiner*—John L. Goodrow
*Attorney, Agent, or Firm*—David G. Alexander

[57] ABSTRACT

A single magnetic brush developing unit is disposed adjacent to a photoconductive drum for applying toner thereto. Three applicator units are selectively actuatable to apply three toners of respective primary colors to the developing unit.

9 Claims, 3 Drawing Figures

COLOR ELECTROSTATOGRAPHIC APPARATUS

BACKGROUND OF THE INVENTION

The present invention relates to an improved electrostatographic apparatus such as an electrostatic copying machine comprising improved developing means.

In such a copying machine a light image of an original document is radiated onto a photoconductive drum, belt or the like through three respective primary color filters. After each imaging operation a toner of the respective complimentary primary color is applied to the drum to form a toner image which is transferred to a copy sheet. The three toner images in registration on the copy sheet form a full color copy. In some copying machines, a fourth color, black, is also provided.

The three toners are applied to the drum by three respective developing units. Each developing unit comprises a container for the toner and a magnetic brush unit for applying the toner to the drum. Each magnetic brush unit comprises a rotary non-magnetic cylinder and a plurality of magnets disposed inside the cylinder. Rotation of the cylinder in combination with the magnetic force of the magnets causes toner to adhere to the outer surface of the sleeve in the form of a brush which engages the drum. The toner adheres to the high electrostatic charge areas on the drum to form the toner image.

Color electrostatic copying machines of this type have heretofore suffered from several disadvantages regarding the developing apparatus. Prior art machines comprise three complete magnetic brush developing units. These units may be fixedly mounted in a circumferentially spaced arrangement about the drum. This arrangement is disadvantageous in that a large portion of the circumference of the drum is required to accommodate the developing units and therefore the drum must be larger than is required for a monochromatic copying machine. Also, means must be provided to individually actuate the developing units at the proper times while maintaining the other developing units inoperative. A copying machine of this type must be cleaned frequently since toner from the developing units tends to be scattered about the inside of the housing. As yet another drawback such a copying machine must be necessarily large in size to accommodate the three developing units and therefore expensive to manufacture.

Another type of prior art color copying machine does not fixedly mount the three developing units about the circumference of the drum but instead movably mounts them so as to be individually movable into close proximity with the drum for operation. This type of apparatus is disadvantageous in that the gap between the sleeves of the developing units and the drum is critical and is difficult to correctly attain with the three developing units being movably mounted. Also, in order to move the developing units at a reasonably high speed the drive means must be large in size and consume a large amount of electrical power. In addition, the overall dimensions of the copying machine must be large in order to provide sufficient space for movement of the developing units.

SUMMARY OF THE INVENTION

An electrostatographic apparatus embodying the present invention comprises a rotary photoconductive member and a rotary magnetic brush developing means operatively disposed closely adjacent to the photoconductive member for applying toner thereto. The present apparatus further comprises a plurality of applicator means which are selectively actuatable for applying toners of different respective colors to the developing means and actuator means for selectively actuating the applicator means.

It is an object of the present invention to provide an electrostatographic apparatus such as a color copying machine which is more compact than heretofore attainable.

It is another object of the present invention to provide a color copying machine which eliminates scattering of toner therein.

It is another object of the present invention to provide a color copying machine which may be manufactured and maintained easier and at lower cost than has been possible heretofore.

It is another object of the present invention to provide a generally improved electrostatographic apparatus.

Other objects, together with the following, are attained in the embodiment described in the following description and shown in the accompanying drawing.

DESCRIPTION OF THE PREFERRED EMBODIMENT

While the electrostatographic apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
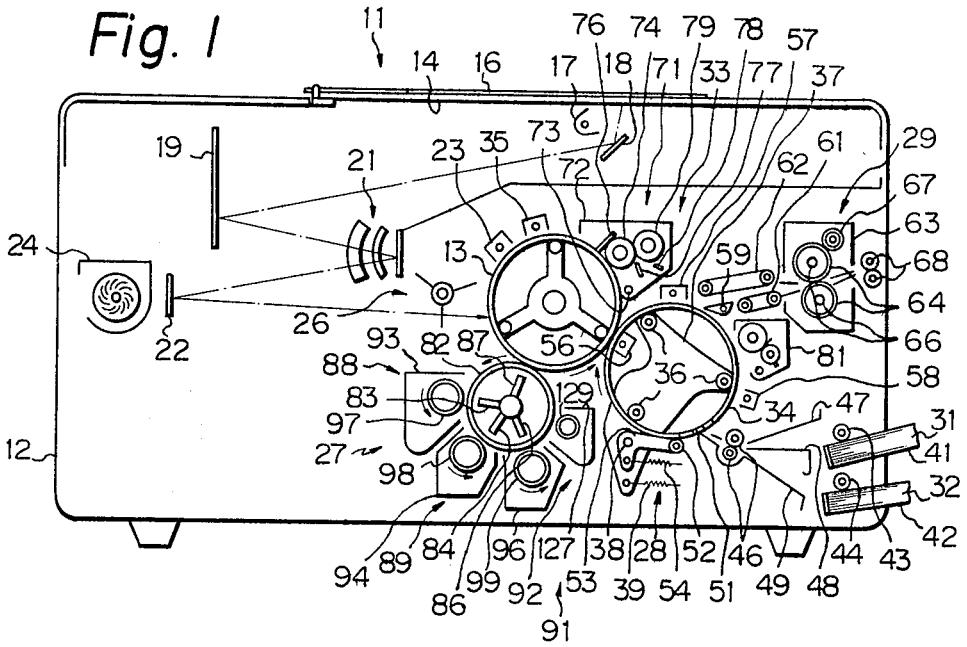
FIG. 1 is an elevational view of an electrostatographic apparatus embodying the present invention.

Referring now to FIG. 1 of the drawing, an electrostatographic apparatus embodying the present invention is here shown as being in the form of a color copying machine which is generally designated by the reference numeral 11 and comprises a housing 12. A photoconductive drum 13 is mounted inside the housing 12 and rotated counterclockwise at constant speed. The upper surface of the housing 12 is formed with an opening (not designated) over which is placed a transparent platen 14. An opaque pressure plate 16 is hinged to the housing 12 for pressing an original document (not shown) against the platen 14. The document is placed on the platen 14 face down and illuminated from below by a lamp 17.

More specifically, the lamp 17 illuminates a linear portion of the document through the platen 14. A mirror 18 reflects a light image of the linear portion to mirror 19 which reflects the light image to an in-mirror lens assembly 21. The assembly 21 converges the image twice and reflects it to a mirror 22 which in turn reflects the image onto the drum 13. The lens assembly 21 is designed to focus the image on the drum 13.

For scanning the document, the lamp 17 and mirror 18 are moved leftwardly at the same surface speed as the drum 13. The mirror 19 is also moved leftwardly but at one-half the surface speed of the drum 13. As a result of this operation a light image of the entire document is progressively focussed onto the drum 13 to form an electrostatic image on the drum 13 through localized photoconduction.

Prior to imaging of the drum 13, a corona charging unit 23 applies a uniform electrostatic charge to the drum 13. This charge is locally dissipated through photoconduction in the bright areas of the light image. Illustrated rightwardly of the mirror 22 is a blower 24 for cooling the internal components of the apparatus 11.

Disposed between the mirror 22 and drum 13 in the optical path of the light image is a rotary filter assembly 26. Although not specifically labeled in the drawing, the filter assembly 26 comprises blue, green and red filters which are selectively movable into the optical path of the light image.

Further illustrated in FIG. 1 are a developing unit 27, a transfer unit 28 and a fixing unit 29. The overall operation of these units will be described first, and the detailed construction and operation thereof will be described later.

First, the document is scanned and the light image radiated onto the drum 13 through the blue filter of the assembly 26. Then, the developing unit 27 applies yellow toner (the complimentary color to blue) to the drum 13 to form a yellow toner image thereon. This yellow toner image is transferred to a copy sheet 31 or 32 by the transfer unit 28.

Then, the document is scanned a second time and the light image radiated onto the drum 13 through the green filter of the filter assembly 26. The developing unit 27 applies magenta toner (the complimentary color to green) to the drum 13 to form a magenta toner image. The transfer unit 28 transfers the magenta toner image onto the copy sheet 31 or 32 on top of, or in register with, the yellow toner image.

Next, the document is scanned a third time and the light image radiated onto the drum 13 through the red filter of the filter assembly 26. The developing unit 27 applies cyan toner (the complimentary color to red) to the drum 13 to form a cyan toner image. The transfer unit 28 transfers the cyan toner image to the copy sheet 31 or 32 in register with the yellow and magenta toner images. Further illustrated are a cleaning unit 33 and a corona discharging unit 35 which clean and discharge the drum 13 after each developing operation. It will be understood that the charging unit 23 charges the drum 13 before each imaging operation.

After the three toner images are formed on the copy sheet 31 or 32, the copy sheet is fed through the fixing unit 29 which fixes the toner images thereto to form a full color reproduction of the original document.

The transfer unit 28 comprises a transfer cylinder 34 of hollow construction which is rotatably supported by means of three rollers 36. The rollers 36 are rotatably supported by a plate 37 which is pivotable about a shaft 38. A tension spring 39 urges the plate 37 counterclockwise about the shaft 38 so as to urge the cylinder 34 into engagement with the drum 13. Since the cylinder 34 is rotatably mounted on the rollers 36, it is driven clockwise by the drum 13. The cylinder 34 is typically made of a resilient rubber or plastic material formed on the outer periphery of a rigid support, although not shown in detail.

The copy sheets 31 and 32 are of different sizes such as A4 and B4 and are stacked in cassettes 41 and 42 respectively. Feed rollers 43 and 44 feed the selected sheet 31 or 32 toward the drum 13. The sheet 31 is guided into the bite of timing rollers 46 by guides 47 and 48. The sheet 32 is guided into the bite of the rollers 46 by the guide 48 and a guide 49.

When the transfer cylinder 34 reaches a proper position relative to the first (yellow) toner image on the drum 13, the rollers 46 feed the copy sheet 31 or 32 into the bite of a clamp 51 which is provided to the cylinder 34. The clamp 51 then closes, firmly fixing the leading edge of the copy sheet 31 or 32 to the cylinder 34. Further illustrated is a roller 52 mounted on one end of a bellcrank lever 53 which is pivotal about the shaft 38. A tension spring 54 urges the bellcrank lever 53 counterclockwise so that the roller 52 engages the drum 13. The copy sheet 31 or 32 passes between the cylinder 34 and roller 52 and is thereby wound around the cylinder 34.

Located inside the cylinder 34 is a corona transfer charger 56. The toner may be of either of two types. The first type is generally known as a one-component type since it consists only of colored magnetic particles. Where the particles have low electrical resistance, they are electrostatically charged with a polarity opposite to that of the electrostatic image on the drum 13 through electrostatic induction as they approach the drum 13 from the developing unit 27. Where a one-component toner has high electrical resistance it will be charged to a polarity opposite to the electrostatic image by means in the developing unit 27 which are not the subject matter of the present invention and are not shown.

The toner may also be of a two-component type comprising magnetic carrier particles and colored nonmagnetic toner particles having high electrical resistance. In this case, the toner particles are charged with a polarity opposite to the electrostatic image triboelectrically through frictional engagement with the carrier particles.

Regardless of the type of toner used, it will have a charge opposite to the electrostatic image on the drum 13 and will be therefore electrostatically attracted to the high potential areas of the electrostatic image. The transfer charger 56 applies a charge to the inside of the cylinder 34 of the same polarity as the electrostatic image, or of the opposite polarity to the toner, and of a magnitude larger than that of the electrostatic image. This causes the toner image to be attracted away from the drum 13 and onto the copy sheet 31 or 32.

A corona discharge unit 57 discharges the copy sheet 31 or 32 and the toner image(s) thereon after each transfer operation. A corona discharge unit 58 discharges the cylinder 34 after the copy sheet 31 or 32 is removed therefrom.

The fixing unit 29 comprises a separator pawl 59 for stripping the copy sheet 31 or 32 off the cylinder 34 after the last transfer operation. The copy sheet 31 or 32 is carried by conveyor belts 61 and 62 into a housing 63 of the fixing unit 29. Inside the housing 63 are provided two fixing rollers 64 which are heated from inside by heaters 66. A releasing of offset preventing agent such as silicone oil is applied to the upper roller 64 by a roller 67. The outer surfaces of the rollers 64 are preferably made of a material such as TEFLON or rubber. The fixing rollers 64 fix the toner images to the copy sheet 31 or 32 by heat and, if desired, pressure. After fixing, the copy sheet 31 or 32 is fed out of the housing 12 by discharge rollers 68.

Further illustrated in FIG. 1 is a cleaning unit 71 which comprises a housing 72 pivotable about a shaft 73. The cleaning unit 71 further comprises a soft, porous roller 74 made of foam styrene or the like and a scraper blade 76. A scraper blade 77 engages the roller 74 and a scraper blade 78 engages a roller 79.

The cleaning unit 71 is normally pivoted clockwise to an inoperative position in which it does not engage the drum 13. However, after each transfer operation a residual amount of toner remains on the drum 13. Thus, after each transfer operation a suitable actuator means pivots the cleaning unit 71 counterclockwise so that the roller 74 and blade 76 frictionally engage the drum 13 and remove the residual toner therefrom. The roller 74 is itself cleaned by the blade 77 which guides the removed toner to the roller 79. The blade 78 removes the toner from the roller 79 and guides it to the lower portion of the housing 72 from which it may be removed for recycling.

An essentially similar cleaning unit 81 is provided to the transfer cylinder 34. The cleaning unit 81 is normally maintained inoperative and is moved into operative engagement with the transfer cylinder 34 to remove any toner therefrom after the last transfer operation is completed and the copy sheet 31 or 32 removed from the cylinder 34. The cleaning unit 81 comprises the same elements as the cleaning unit 71. These elements are not particularly designated by reference numerals to avoid cluttering of the drawing.

Figure 2:
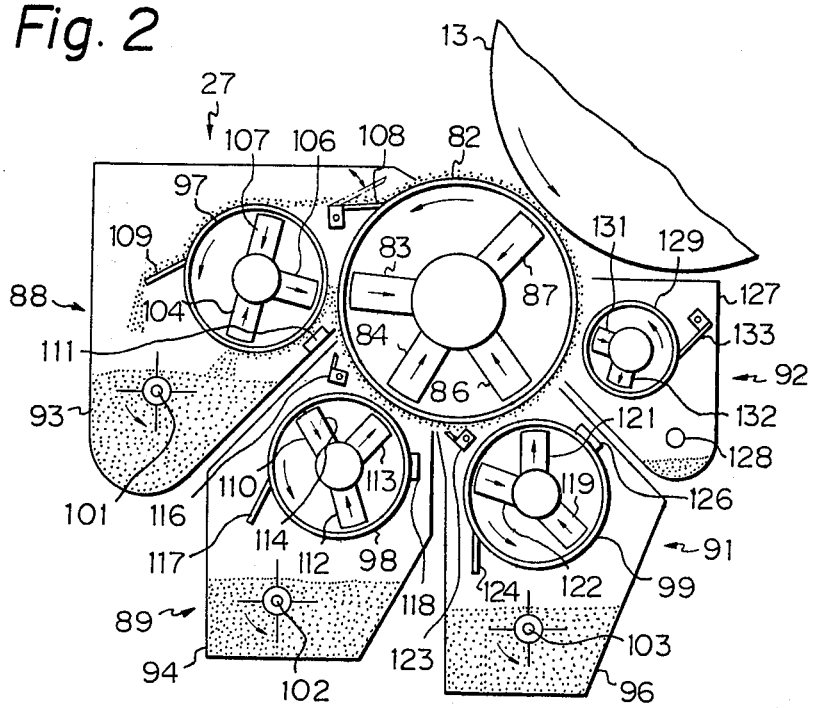
FIG. 2 is a fragmentary elevational view, to an enlarged scale, of a first developing means of the present apparatus.

The developing unit 27 is shown in greater detail in FIG. 2 and comprises a rotary non-magnetic hollow cylinder 82 which is rotated counterclockwise at constant speed closely adjacent to the drum 13. Fixedly mounted inside the cylinder 82 are four magnets 83, 84, 86 and 87 which will be described in detail later.

Circumferentially spaced about the cylinder 82 are three applicator units 88, 89 and 91 and a cleaning unit 92. The applicator units 88, 89 and 91 comprise containers 93, 94 and 96 which serve as reservoirs for yellow, magenta and cyan toners respectively. Hollow non-magnetic cylinders 97, 98 and 99 are disposed in the containers 93, 94 and 96 closely adjacent to the cylinder 82 and are rotatable counterclockwise at constant speed. Further disposed in the containers 93, 94 and 96 are impellers 101, 102 and 103 which are rotatable counterclockwise to homogenize the toners and feed them toward the cylinders 97, 98 and 99 respectively.

The applicator unit 88 further comprises three magnets 104, 106 and 107 which are fixedly mounted inside the cylinder 97. The applicator unit 88 yet further comprises a scraper blade 108 which is movable into engagement with the cylinder 82 to remove toner therefrom and guide it toward the cylinder 97, a scraper blade 109 which functions to remove toner from the cylinder 97 and return it to the lower portion of the container 93 and a block 111 which is movable into engagement with the cylinder 97.

The construction of the applicator units 89 and 91 is essentially similar to that of the applicator unit 88. The applicator unit 89 comprises magnets 112, 113 and 114, a scraper blade 116, a scraper blade 117 and a block 118. The applicator unit 91 comprises magnets 119, 121 and 122, scraper blades 123 and 124 and a block 126.

The cleaning unit 92 comprises a housing 127 which is pivotable about a shaft 128. A non-magnetic cylinder 129 is rotatably supported in the housing 127 and rotated counterclockwise a constant speed. Magnets 131 and 132 are fixedly mounted inside the cylinder 129. A scraper blade 133 engages the cylinder 129 to remove toner therefrom and guide it to the lower portion of the housing 127.

For developing the yellow toner image, the scraper blade 108 is engaged with the cylinder 82 and the cylinder 97 and impeller 101 of the applicator unit 88 are driven for rotation by the actuator means. The block 111 is disengaged from the cylinder 97. However, the scraper blades 116 and 123 of the applicator units 89 and 91 are disengaged from the cylinder 82 and rotation of the cylinders 98 and 99 and impellers 102 and 103 is stopped. The blocks 118 and 126 are engaged with the cylinders 98 and 99 respectively. The cleaning unit 92 is pivoted clockwise to the inoperative position thereof.

As indicated by arrows, the yellow toner is attracted by the magnet 104 of the applicator unit 88 onto the surface of the cylinder 97 to form a magnetic brush. The magnet 106 is arranged with its poles radially opposite to those of the magnet 104 and serves to repel the toner against the cylinder 82. The magnet 83 which is mounted inside the cylinder 82 is arranged to attract the toner onto the surface of the cylinder 82. It will be noted that the forces of the magnets 106 and 83 are thereby combined.

The toner attracted to the cylinder 82 forms a magnetic brush thereon which brushingly engages the drum 13 to develop the yellow toner image thereon. Toner which is not consumed in the developing operation is scraped off the cylinder 82 by the scraper blade 108 and guided thereby to the cylinder 97. The magnet 107 is arranged to attract the toner from the scraper blade 108 onto the cylinder 97. Finally, the scraper blade 109 removes any remaining toner from the cylinder 97 and returns it to the lower portion of the container 88. It will be noted that new magnetic brushes are formed on the cylinders 97 and 82 during each revolution thereof.

After the developing operation is completed, the actuator means moves the cleaning unit 92 into operative engagement with the cylinder 82 to remove any remaining toner therefrom. This is necessary prior to applying toner of the next colar to the cylinder 82. The magnet 131 attracts toner from the cylinder 82 onto the cylinder 129. The magnet 132 repels the toner away from the cylinder 129 into the lower portion of the housing 127 and the scraper blade 133 removes any unrepelled toner from the cylinder 129. The cylinder 82 is rotated for one or more revolutions after completion of the developing operation to enable the cleaning unit 92 to completely clean the same. After the cleaning operation is completed, the cleaning unit 92 is moved away from the cylinder 82 by the actuator means.

To develop the magenta toner image on the drum 13, the applicator unit 88 is de-actuated and the actuator unit 89 is actuated to apply magenta toner to the cylinder 82. More specifically, the scraper blade 108 is moved away from the cylinder 82 and rotation of the cylinder 97 and impeller 101 is stopped. The block 111 is moved into engagement with the cylinder 97 to prevent the yellow toner from escaping from the container 93.

The scraper blade 116 of the applicator unit 89 is moved into engagement with the cylinder 82 and the cylinder 98 and impeller 102 are driven for rotation by the actuator means. The block 118 is moved out of engagement with the cylinder 98. The cylinder 98 applies magenta toner to the cylinder 82 in the same manner in which the cylinder 97 applies yellow toner to the cylinder 98. The magenta toner is applied from the cylinder 98 to the cylinder 82 which applies the same to the drum 13 to develop the magenta toner image thereon. The magnet 112 attracts the magenta toner from the container 94 onto the cylinder 98. The magnet 113 repels the magenta toner from the cylinder 98 onto the cylinder 82. The magnet 84 attracts toner from the cylinder 98 onto the cylinder 82. The magnet 114 attracts toner from the cylinder 82 onto the cylinder 98. The magnet 87, in the case of a two-component toner is arranged to attract the magnetic carrier particles to the cylinder 82 and enable separation of the toner particles therefrom by the electrostatic image on the drum 13. The carrier particles and residual toner particles are returned to the cylinder 98 by the scraper blade 116. In the case of a one-component toner, the magnet 113 may be arranged to repel the toner against the drum 13 and thereby enhance development.

After development of the magenta toner image, the cylinder 82 is cleaned by the cleaning unit 92 and the applicator unit 91 is actuated to apply cyan toner to the cylinder 82. The scraper blade 116 is moved away from the cylinder 82 and the cylinder 98 and impeller 102 stopped. The block 118 is moved into engagement with cylinder 98 thereby de-actuating the applicator unit 89. The scraper blade 123 is moved into engagement with the cylinder 82 and the cylinder 99 and impeller 103 driven for rotation. The block 126 is moved away from the cylinder 99. In this manner, the applicator unit 91 is actuated to apply the cyan toner to the drum 13 and thereby develop the cyan toner image.

Figure 3:
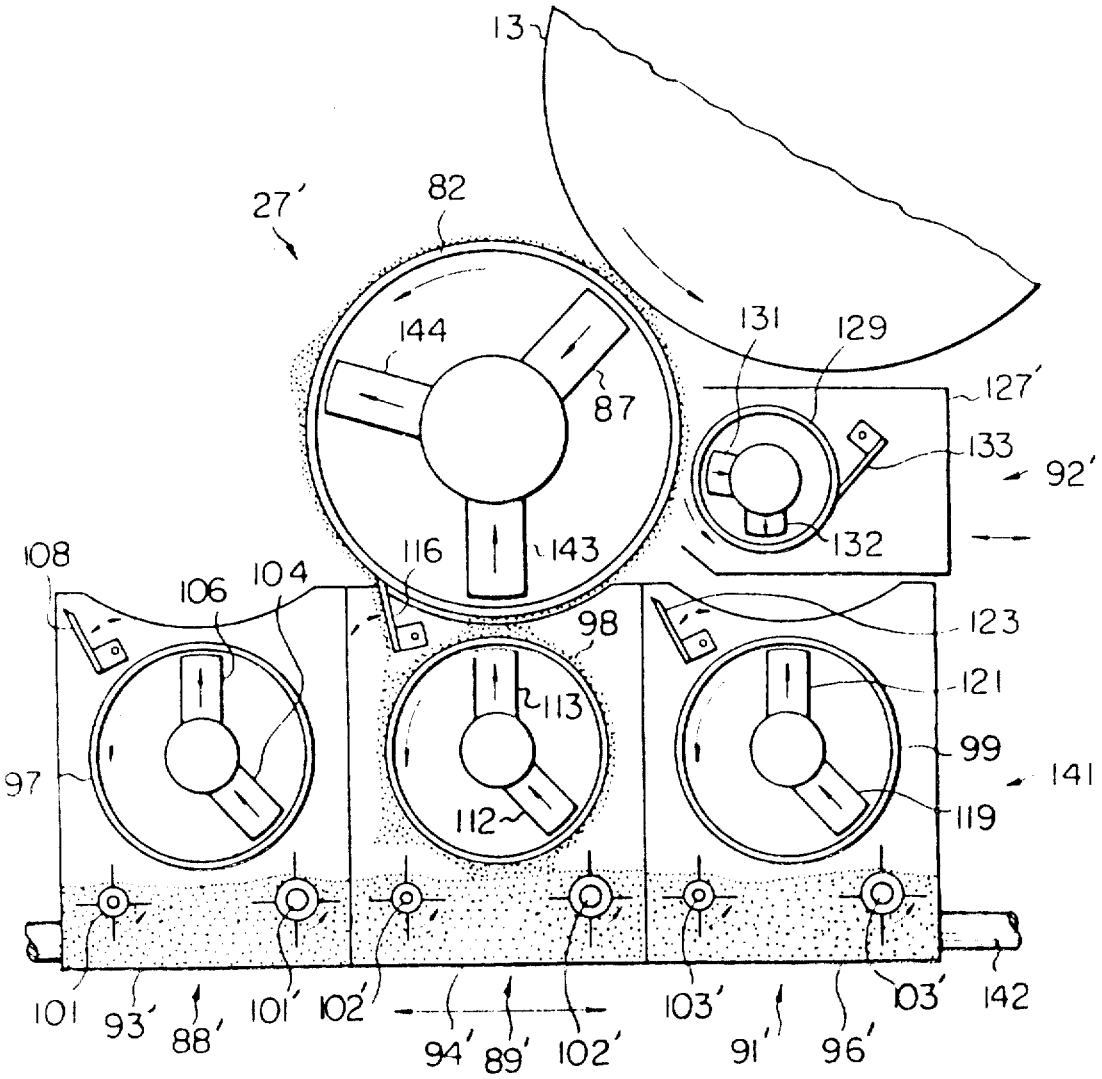
FIG. 3 is similar to FIG. 2 but shows a second developing means.

FIG. 3 shows another embodiment of the present invention in which like elements are designated by the same reference numerals and corresponding but modified elements are designated by the same reference numerals primed.

In FIG. 3 containers 93', 94' and 96' are attached together to form a carriage 141 which is linearly movable on one or more tracks 142 below the cylinder 82. Applicator units 88', 89' and 91' are linearly spaced from each other in the direction of the tracks 142.

To develop the yellow toner image, the carriage 141 is moved to position the applicator unit 88' operatively below the cylinder 82. To develop the magenta and cyan toner images, the carriage 141 is moved to sequentially position the applicator units 89' and 91' under the cylinder 82. The operation of the individual applicator units 88', 89' and 91' is the same as described above with respect to the applicator units 88, 89 and 91 except as will be described below.

In the FIG. 3 embodiment only one magnet 143 is provided inside the cylinder 82 for attracting toner thereto from the applicator units 88', 89' and 91'. In other words, the magnet 143 replaces the magnets 83, 84 and 86. However, another magnet 144 is provided inside the cylinder 82 to repel the toner therefrom and thereby facilitate removal thereof by the scraper blades 108, 116 and 123.

The magnets 107, 114 and 122 as well as the scraper blades 109, 117 and 124 are omitted. This arrangement allows a magnetic brush to be continuously formed on the cylinders 97, 98 and 99.

The impellers 101, 102 and 103 are replaced by two each of impellers 101', 102' and 103'. As yet another point of difference, a cleaning unit 92' is movable linearly, rather than pivotally, between inoperative and operative positions relative to the cylinder 82.

It will be seen that the present invention substantially reduces the amount of space required by the developing means of an electrostatic copying machine. Whereas prior art copying machines comprise three complete developing units, the present apparatus comprises a single cylinder 82 which functions to develop toner images on a photoconductive drum 13 and three small applicator units which apply toners of different colors to the cylinder 82. Whether the applicator units are fixed in position or movable relative to the cylinder the result in a very compact construction compared to the prior art. The present invention further eliminates scattering of toner inside the copying machine housing by means of the scraper blades 108, 116 and 123 and the blocks 111, 118 and 126.

The fact that the present apparatus comprises only one developing cylinder makes it possible to reduce the diameter of the photoconductive drum and thereby speed up the copying operation. The smaller drum substantially reduces the cost of the apparatus.

On the other hand, the diameter of the developing cylinder 82 can be increased over the prior art and thereby enable the use of stronger and more effective magnets in the developing and actuator cylinders. While the present invention has been shown and described as applied to a three color copying machine, the invention is also applicable to two or more than three color electrostatographic apparatus. Such a two color copying machine may simulate the effect of two color copying by means of monochromatic copying using different toner densities.

What is claimed is:

1. An electrostatographic apparatus including a rotary photoconductive member and a rotary magnetic brush developing means operatively disposed closely adjacent to the photoconductive member for applying toner thereto, characterized by comprising:

a plurality of applicator means which are fixed in position and selectively actuatable for applying toners of different respective colors to the developing means; and actuator means for selectively actuating the applicator means;

each applicator means comprising container means for containing the toner and magnetic brush means for applying the toner from the container means to the developing means;

each applicator means comprising removal means disposed downstream of the photoconductive member and upstream of the magnetic brush means in a direction of rotation of the developing means for removing toner from the developing means;

each removal means being normally maintained inoperative and being actuated for operation by the actuator means together with the respective magnetic brush means.

2. An apparatus as in claim 1, in which each removal means comprises a scraper which is movable into and out of engagement with the developing means by the actuator means.

3. An apparatus as in claim 1, in which each removal means is constructed to return removed toner to the respective magnetic brush means.

4. An apparatus as in claim 3, in which each magnetic brush means comprises a hollow rotary cylinder and first, second and third magnets disposed inside the cylinder, the first magnet being constructed to attract the toner from the container means onto the cylinder, the second magnet being constructed to repel the toner from the cylinder onto the developing means and the third magnet being constructed to attract the toner from the removal means onto the cylinder.

5. An apparatus as in claim 4, in which each magnetic brush means further comprises second removal means disposed downstream of said removal means and upstream of the container means in the direction of rotation of the cylinder for removing the toner from the cylinder and returning the removed toner to the container means.

6. An apparatus as in claim 4, in which the developing means comprises a hollow rotary cylinder and a magnet disposed inside the cylinder of the developing means for attracting toner from the cylinder of a selected applicator means to the cylinder of the developing means.

7. An apparatus as in claim 1, further comprising cleaning means for cleaning toner from the developing means disposed downstream of the applicator means and upstream of the photoconductive member in a direction of rotation of the developing means, the cleaning means being normally maintained inoperative and being actuatable for operation by the actuator means.

8. An apparatus as in claim 7, in which the actuator means is constructed to sequentially actuate the applicator means, the actuator means actuating the cleaning means during time periods between actuation of the applicator means.

9. An apparatus as in claim 1, in which the actuator means is constructed to sequentially actuate the applicator means.

* * * * *

UNITED STATES PATENT AND TRADEMARK OFFICE

CERTIFICATE OF CORRECTION

PATENT NO. : 4,422,405

DATED : December 27, 1983

INVENTOR(S) : Nobuo Kasahara et al.

It is certified that error appears in the above-identified patent and that said Letters Patent is hereby corrected as shown below:

Fig. 3 should appear as shown on the attached sheet.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*

Patent No. 4,422,405 December 27, 1983

Nobuo Kasahara et al.